US009758911B2

(12) United States Patent
Bach et al.

(10) Patent No.: US 9,758,911 B2
(45) Date of Patent: Sep. 12, 2017

(54) SEWING NEEDLE WITH DOUBLE TWIST GROOVE

(71) Applicant: GROZ-BECKERT KG, Albstadt (DE)

(72) Inventors: Dirk Bach, Albstadt (DE); Kai Uwe Haug, Nusplingen (DE); Alexander Merks, Albstadt (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 15/113,350

(22) PCT Filed: Jan. 19, 2015

(86) PCT No.: PCT/EP2015/050898

§ 371 (c)(1),
(2) Date: Jul. 21, 2016

(87) PCT Pub. No.: WO2015/110386

PCT Pub. Date: Jul. 30, 2015

(65) Prior Publication Data

US 2017/0009389 A1 Jan. 12, 2017

(30) Foreign Application Priority Data

Jan. 21, 2014 (EP) ..... 14151978

(51) Int. Cl.
*D05B 85/02* (2006.01)
*D05B 85/00* (2006.01)

(52) U.S. Cl.
CPC ..... *D05B 85/02* (2013.01); *D05B 85/00* (2013.01)

(58) Field of Classification Search
CPC ..... D05B 85/02–85/14
See application file for complete search history.

(56) References Cited

U.S. PATENT DOCUMENTS 357,805 A * 2/1887 Willcox ..... D05B 85/00 112/222
1,323,340 A * 12/1919 Weis ..... D05B 85/00 112/222

(Continued)

FOREIGN PATENT DOCUMENTS

DE 8632106.4 9/1987
DE 102009004033 A1 8/2009

(Continued)

OTHER PUBLICATIONS

International Search Report for International Application No. PCT/EP2015/050898 dated Mar. 19, 2015 (6 pages).

*Primary Examiner* — Danny Worrell
(74) *Attorney, Agent, or Firm* — Merchant & Gould P.C.

(57) ABSTRACT

A sewing needle is used in a sewing machine. The sewing needle has a working portion with a needle eye and a region which tapers into a needle tip. The needle eye passes through a needle body in a transverse direction perpendicularly to a longitudinal axis of the needle body. A twist groove is recessed in a front face of the needle body relative to the outer contour of the needle body, the twist groove extending in the direction of the needle tip from the needle eye. The twist groove is formed by a thread groove. The twist groove is preferably symmetrical relative to a first longitudinal central plane spanned by the longitudinal axis and the transverse direction. The thread groove has a groove portion adjacent to the needle eye and two end portions, each having a thread groove opening, remote from the needle eye.

15 Claims, 10 Drawing Sheets

(56) References Cited

U.S. PATENT DOCUMENTS

| | | | | | |
|---|---|---|---|---|---|
| 2,221,419 | A * | 11/1940 | Antcliff | D05B 85/02 | 112/224 |
| 3,322,085 | A * | 5/1967 | Weiss | D05B 85/00 | 112/222 |
| 3,908,569 | A | 9/1975 | Ketterer | | |
| 6,952,999 | B2 * | 10/2005 | Toya | D05B 85/00 | 112/222 |
| 6,986,315 | B2 * | 1/2006 | Toya | D05B 85/00 | 112/222 |
| 2001/0015162 | A1 * | 8/2001 | Hillenbrand | D05B 85/00 | 112/222 |

FOREIGN PATENT DOCUMENTS

| | | | |
|---|---|---|---|
| EP | 1127973 | A1 | 8/2001 |
| GB | 703934 | | 2/1954 |
| GB | 734656 | | 8/1955 |

* cited by examiner

SEWING NEEDLE WITH DOUBLE TWIST GROOVE

This application is a National Stage Application of PCT/EP2015/050898, filed 19 Jan. 2015, which claims benefit of Ser. No. 14/151,978.5, filed 21 Jan. 2014 in the European Patent Office and which applications are incorporated herein by reference. To the extent appropriate, a claim of priority is made to each of the above disclosed applications.

BACKGROUND

The invention relates to a sewing needle for a sewing machine, wherein said needle may thus also be referred to as a machine sewing needle. The sewing needle comprises a needle body that has, on its one end, a holding portion for clamping the sewing needle into a corresponding holding arrangement of the sewing machine. On the side opposite the holding portion, the needle body has a working portion that terminates in the needle tip. In this working portion of the needle body, there is also provided a needle eye which extends completely through the needle body and through which the upper thread passes during the sewing operation.

Frequently, sewing needles are manufactured with the use of a stamping process. In doing so, frequently a recess is formed adjoining the needle eye in the direction of the longitudinal axis, said recess being referred to as the tip groove. This tip groove also exists in document EP 1 127 973 B1 and is designed so as to be deeper opposite the two lateral walls of the needle eye, so that the sewing thread slides over a flank or edge between the tip groove and the lateral wall of the needle eye when the sewing direction is changed. As a result of this, a twist shifting of the sewing thread may occur.

A sewing needle for multi-directional sewing has been known from document EP 1 127 973 B1. The sewing needle has an elongated needle eye that extends through the needle body and is delimited by two opposing lateral walls. The needle body extends along a longitudinal axis. In order to spare the thread guided during the needle eye during the sewing operation, the two lateral walls are curved in a concave manner on their lateral wall edges—viewed in the direction of the longitudinal axis. When the thread exits in an oblique manner or laterally from the needle eye, it will be guided over one of the two concavely lowered lateral walls of the needle eye. Due to this measure a twist shifting of the sewing thread is to be avoided. While the thread is moving over the lateral wall, the twisting effect of the sewing thread should only be minimally changed or not changed, as a result of which sewing errors are avoided and a thread is spared.

Document DE 10 2009 004 033 A1 describes a sewing needle for a sewing machine that has a groove extending in the direction of the longitudinal axis in the needle body on the side opposite the needle tip, said groove terminating in the needle eye. At one point before the termination of the groove in the needle eye, said groove has a portion that is angled relative to the longitudinal axis of the needle body. Due to this angled groove, the compressive force acting on the sewing thread in the region of the needle eye is intended to be oriented in the direction of the tilt of the sewing thread in order achieve the untwisting of the sewing thread.

Document DE 86 32 106 U1 describes a tufting needle in which the needle tip is offset relative to the needle axis in transport direction of the backing. This is to prevent that when the backing of the previously laid thread is punctured and thus damaged due to the oscillations of the tufting needle. The tufting needle may also have a thread groove that extends in an oblique manner starting from the needle eye—in a manner so as to be inclined relative to the longitudinal axis of the needle—and ends above the needle tip. As a result of this, the thread is to be deflected from the longitudinal axis of the needle where the needle tip is located.

The needle described in document GB 703 934 A is designed specifically for use when sewing a shoe. The needle is designed without a needle eye and has in the needle body in a working portion a recess, as a result of which a hook-like projection is formed. The needle is punctured through the material to be sewn. With this projection it is possible to grasp a thread loop—similar to crocheting—and to pull it on the other side of the sewn material. Thus, this needle is specifically configured to perform a sewing stitch type 101 compliant with DIN 614:2002-04.

SUMMARY

Considering this prior art, the object of the invention may be viewed to be the provision of a sewing needle for a sewing machine that displays sufficient or improved stability in the region of the needle eye and thus avoids or minimizes twist shifting of the sewing thread.

The sewing needle has a needle body extending along a longitudinal axis with a holding portion and a working portion. The holding portion and the working portion are provided on opposite end regions of the needle body. The holding portion is disposed for clamping the sewing needle into an appropriate holding or clamping device of the sewing machine. Within the working portion, the needle body tapers toward the needle tip. Also provided in the working portion is a needle eye which extends completely through the needle body from a front side to a back side of the needle body in transverse direction and through which the upper thread is guided for sewing. The needle eye is delimited by two opposing lateral walls in a lateral direction that is oriented at a right angle relative to the longitudinal axis and the transverse direction.

Looking in the direction of the longitudinal axis, there is provided, between the needle eye and the needle tip, a thread groove in the front face of the needle body. This thread groove is a twist groove. The thread groove is located between the needle eye and the needle tip and has two thread groove openings that are arranged on different sides of a first longitudinal central plane through the needle body. Preferably, the thread groove or the thusly formed twist groove is arranged symmetrically relative to this first longitudinal central plane through the needle body. The first longitudinal central plane extends along the longitudinal axis of the needle body as well as in transverse direction. The transverse direction is oriented at a right angle with respect to the longitudinal axis. The thread groove that is recessed relative to the outer contour of the needle body adjoins the two thread groove openings. The thread groove openings form transition areas where the thread groove inside surface adjoins the outer contour surface of the needle body. The thread groove terminates at a lower edge of the needle eye in the needle eye, at a distance from the two thread groove openings.

Due to this configuration of the sewing needle, the thread moves during the sewing operation from the sewn material through one of the two thread groove openings in the thread groove and, finally, through the needle eye, at least when the sewing needle is above the sewn material. While or after the sewn material is punctured the thread is pulled out of the thread groove and is pulled in the needle eye by the needle tip away from the thread groove. However, due to the position of the thread groove it can be ensured that the thread remains inside the thread groove during the greatest part of the needle stroke movement—and at least when the needle is at a distance from the sewn material and/or while the sewn material is being transported. The thread groove prevents a twisting or untwisting of the thread and thus a twist shifting. The lateral walls on the sewing needle body delimiting the needle eye can be dimensioned sufficiently large in transverse direction in order to ensure the stability of the sewing needle in the region of the needle eye. Indeed, the sewing thread is pushed out of the thread groove onto the lateral wall of the needle eye when the sewn material is punctured; however, it has been found that this phase of the sewing process has only very little effect on the twist shifting of the thread, so that accordingly enlarged lateral walls may be provided for stabilizing the sewing needle, without any appreciable negative effect on the thread. The thread groove is provided to avoid any twist shifting.

In one exemplary embodiment the distance between the two thread groove openings in a lateral direction is at a right angle with respect to the first longitudinal central plane and is, at least at a few points and preferably at all points, greater than the width of the thread groove in the lateral direction at the point directly adjacent the needle eye. In doing so, it is possible, for example, that one dimension of the thread groove increases in the lateral direction—at least in sections—with increasing distance from the needle eye. The dimension of the thread groove in the lateral direction S corresponds to the greatest-possible dimension, respectively.

The thread groove openings are located on different sides relative to the first longitudinal central plane. In doing so, the thread groove may be preferably configured so as to be symmetrical relative to the first longitudinal central plane. As a result of this it is possible to reverse the transport direction of the sewn material or the sewing direction and to achieve the desired thread sparing in at least two sewing directions. The weakening of the needle body in a region between the needle eye and the needle tip through the thread groove with the two thread groove opening can thus be accepted. It has been found that, as a result of this, no negative oscillation and stability impairments of the sewing needle occur as a result of this. Quite on the contrary, due to the strengthening of the needle body on both sides of the lateral walls of the needle eye, an overall clearly more stable needle is achieved and no, or at most an insignificant, twist shifting of the thread is allowed.

Preferably, the thread groove has—adjoining the needle eye—a groove portion that extends in particular in the direction of the longitudinal axis. This groove portion terminates at the lower edge of the needle eye in the needle eye, said lower edge representing the edge of the needle eye being the closest to the needle tip. Preferably, the groove portion can be delimited on both sides of the first longitudinal central plane by respectively one lateral wall region of a lateral wall delimiting the needle eye. Therefore, the lateral walls delimiting the needle eye have respectively on lateral wall region that continues along the groove portion, delimiting said groove portion in lateral direction. The width of this groove portion in lateral direction may be constant or may become greater—at least in sections—starting from the needle eye and at increasing distance from the needle eye.

The thread groove and thus also the groove portion has a groove bottom or groove base. This groove bottom can be formed by a connecting line of the vertices of the cross-sectional profiles of the thread groove and the groove portion, respectively. Preferably, the groove bottom of the groove portion is inclined in the direction of the longitudinal axis. In particular, the distance of the groove bottom of the groove portion decreases along the longitudinal axis from the needle eye in the direction toward the needle tip.

Furthermore, it can be advantageous when the distance of the groove bottom of the thread groove from a second longitudinal central plane is at no point greater than directly adjacent the needle eye. The second longitudinal central plane is aligned at a right angle with respect to the first longitudinal central plane and extends along the longitudinal axis as well as in lateral direction.

Preferably, the needle body is made of one piece of a cohesive material without any seam and joint points. For example, said needle body may be manufactured from at least one metal starting element that is cylindrical—at least in sections—by means of a stamping process.

Preferably, the thread groove has two end portions that, on the one hand, adjoin the groove portion and that each has a thread groove opening. Each end portion transitions in particular without offsets and/or edges into the groove section. In the preferred exemplary embodiment, the two end portions are arranged on opposite sides of the first longitudinal central plane. Along the first longitudinal central plane, the two end portions may be separated from each other by an elevation. Preferably, the elevation transitions without edges and/or offsets into the two end portions of the thread groove. Consequently, the inner surfaces of the end positions transition into the surface of the elevation, without forming an offset or edge. As a result of this, a thread may slide in gentle manner from the one end portion via the elevation into the other end portion when the transport direction of the sewn material or the sewing direction changes. Preferably, the elevation is curved convexly and is arranged so as to be symmetrical with respect to the first longitudinal central plane. In particular, a vertex of the convex curve of the elevation may be located on the longitudinal central plane.

In a preferred embodiment, the end portions of the thread groove terminate in a tapering region of the working portion. Thus, the end portions of the thread groove adjoin—on their respective ends opposite the groove portion—the outer contour surface of the needle body in the region taping toward the needle tip. In addition, also the groove portion may be arranged, at least partially, in the working portion of the needle body, said portion tapering toward the needle tip.

In lateral direction, the groove portion has a width that is greater than the width of the end portions. The width of the end portion of the thread groove is measured transversely to the thread groove extension direction or thread guiding direction. The thread guiding direction or thread groove extension direction of the two end portions is oriented obliquely with respect to the first longitudinal central plane. The width of the end portions of the groove portion is measured, for example, at the point at which the groove portion or the respective end portion adjoins the outer contour surface of the needle body.

In a preferred embodiment at least the two end portions of the thread groove or the entire thread groove extend through the needle body only one side of the second longitudinal central plane. Due to this configuration there results the option of manufacturing the sewing needle from a blank by means of a stamping process or another forming process. In modification thereof, the thread groove and, in particular, its end portions, could extend through the second longitudinal central plane. In this embodiment, the sewing needle can be produced by means of a cutting manufacturing process or by means of a forming process.

It is advantageous if the two lateral walls arranged on opposite sides of the first longitudinal central plane and delimiting the needle eye adjoin the outer contour surface of the needle body. The lateral wall edge is, at least in sections, at a greater distance from the second longitudinal central plane than the point of the elevation that is at the greatest distance from the second longitudinal central plane and/or than the point of the two thread groove openings that is at the greatest distance. This embodiment imparts the needle body with particularly good stability in the region of the needle eye. The danger of a needle breakage in the region of the needle eye is thus considerably reduced. Preferably, this lateral wall edge has at least one section that extend parallel to the longitudinal axis of the needle body and/or is curved convexly in the direction of the longitudinal axis and, in particular, does not have a concavely curved progression in the direction of the longitudinal axis.

In a preferred exemplary embodiment the needle body has a gripper recess in the direction of its longitudinal axis next to the needle eye. Preferably, the gripper recess is symmetrical with respect to the first longitudinal central plane. The gripper recess is arranged—relative to the second longitudinal central plane—on the side opposite the thread groove opening of the two end portions in the needle eye.

BRIEF DESCRIPTION OF THE DRAWINGS

Advantageous embodiments of the invention can be inferred from the dependent patent claims, the description, as well as the drawings. The description is restricted to the essential features of the invention. Hereinafter, preferred exemplary embodiments of the invention are explained in detail with reference to the appended drawings. They show in FIG. 1 a perspective representation of an exemplary embodiment of a needle according to the invention;

DETAILED DESCRIPTION

Figure 1:
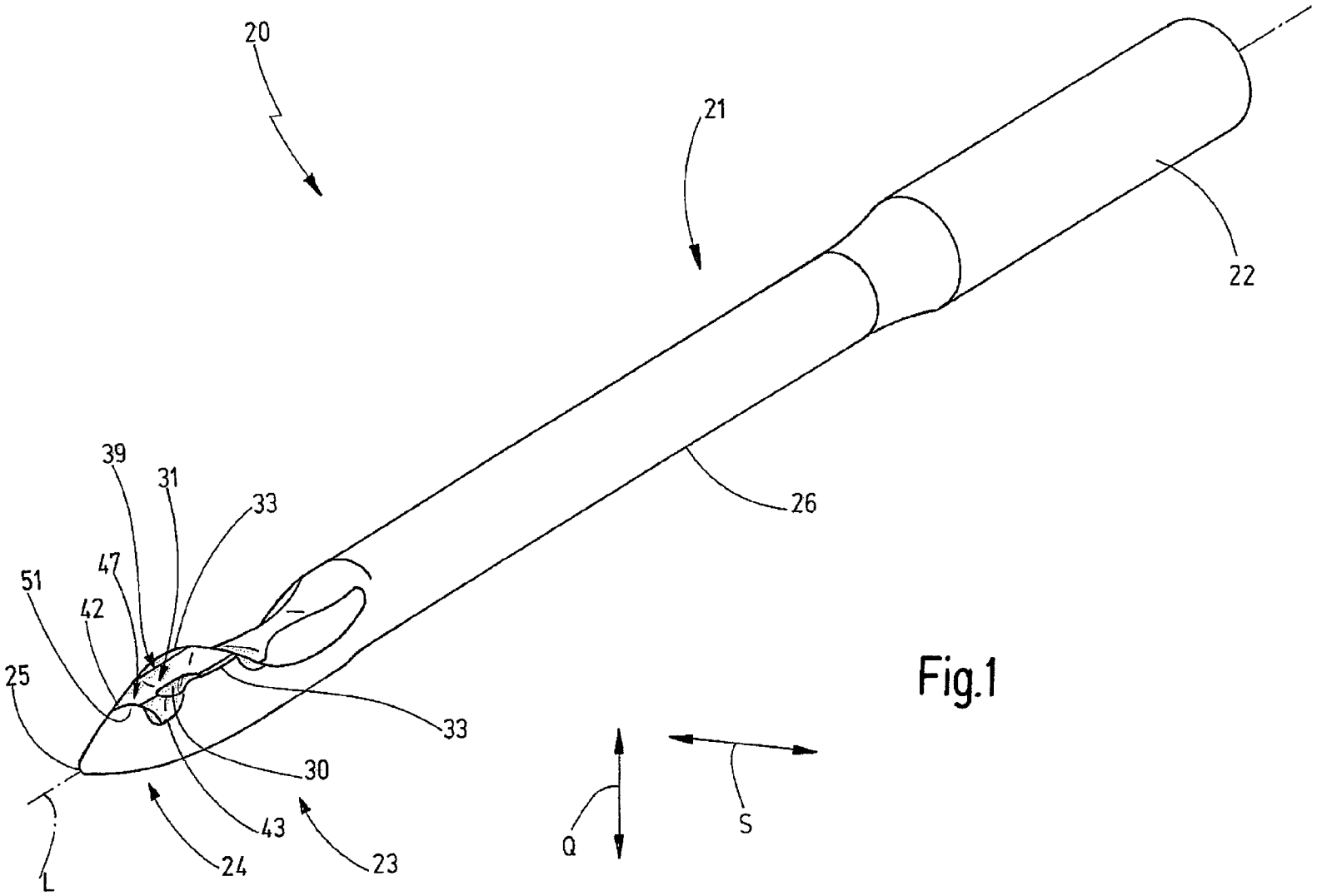
Figure 2:
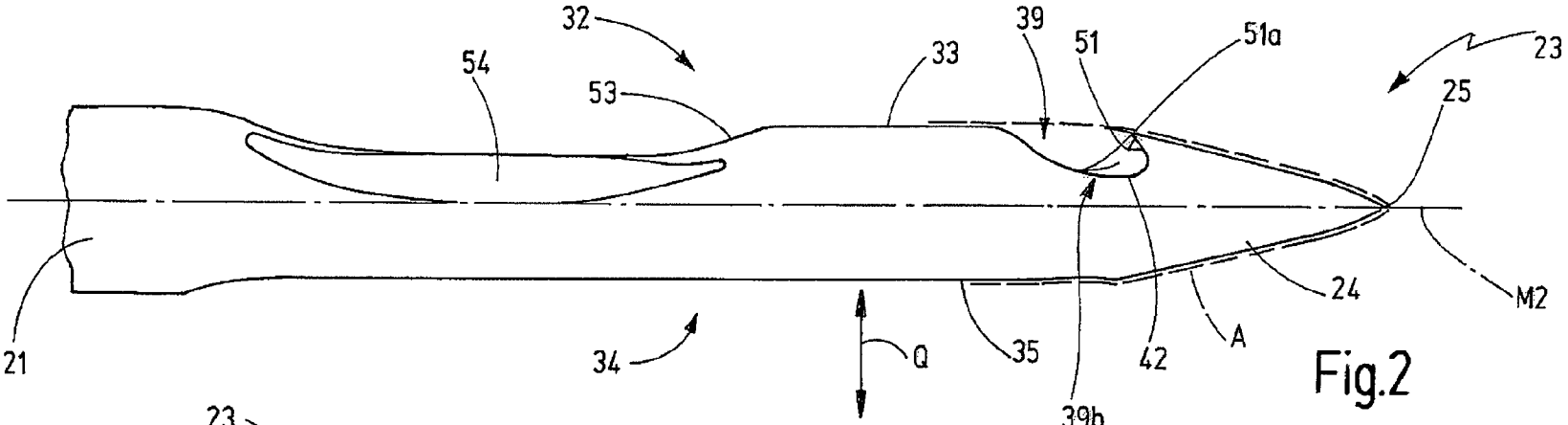
FIG. 2 a side view, in lateral direction, of the working portion of the needle body of the needle according to FIG. 1.
Figure 15:
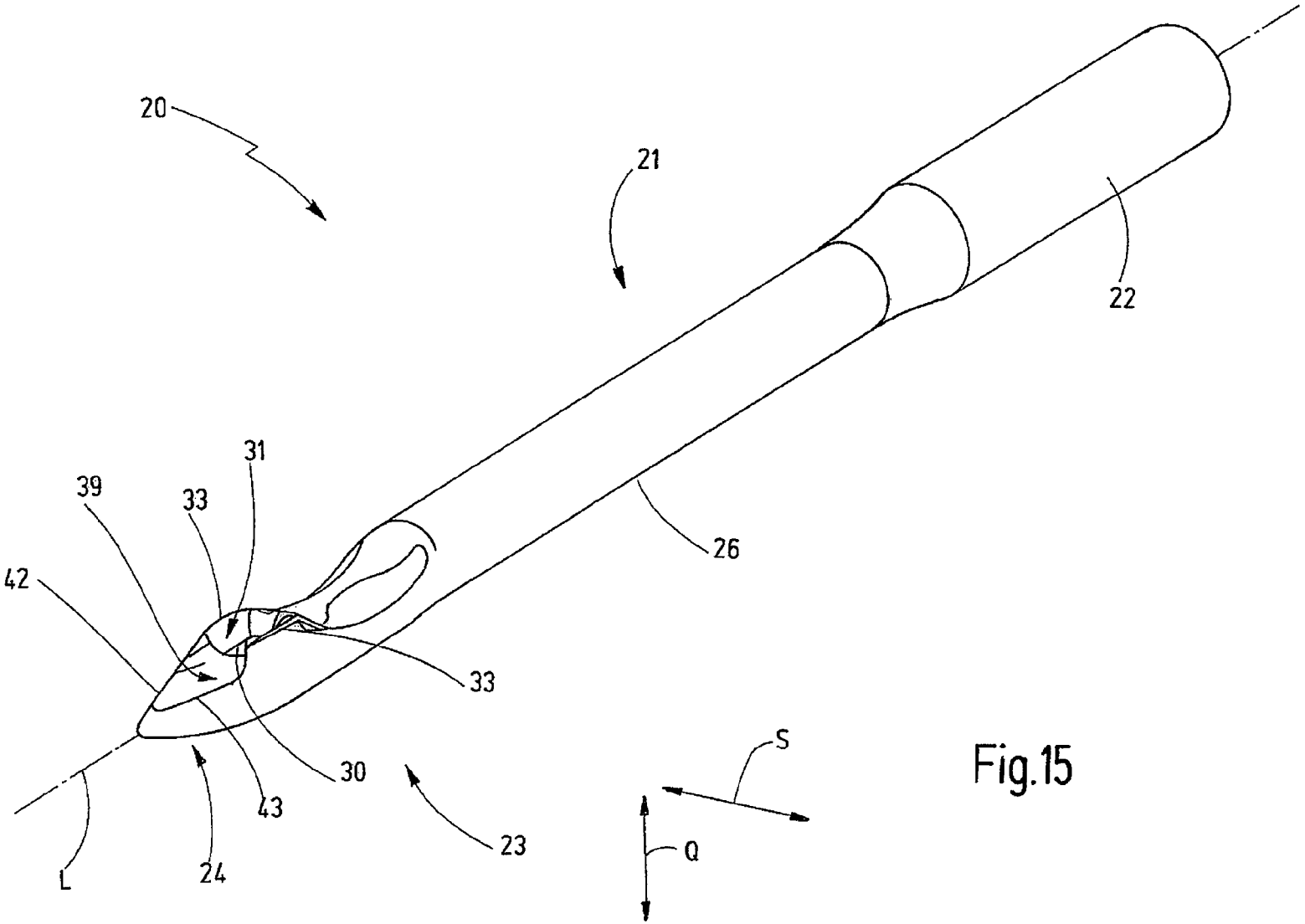
FIG. 15 is a perspective representation of another exemplary embodiment of a needle according to the invention.

FIGS. 1 to 9 show an exemplary embodiment of a sewing needle 20 for use in a sewing machine. The sewing needle 20 has a needle body 21 extending along a longitudinal axis L. The needle body 21 is manufactured of a cohesive material without seam and joint points. Preferably, said needle body consists of metal or of a metal alloy. As shown in FIG. 1 or 15, the needle body 21 has a holding portion 22 in one end region, said holding portion being cylindrical, for example. The holding portion 22 is disposed to clamp in place the sewing needle 20 in a first clamping arrangement of the sewing machine. In an end region opposite the holding portion 22 the needle body 21 has a working portion 23. Provided in the working portion 23 there is a tapering region 24 in which the needle body 21 tapers toward the needle tip 25. As can be seen in FIG. 1, the working portion 23 can be connected via a shank portion 26 to the holding portion 22. In the shank portion 26, the needle body 21 is at least partially cylindrical in accordance with the example and may widen toward the holding portion 22.

A first longitudinal central plane M1 and a second longitudinal central plane M2 that are oriented so as to be at a right angle with respect to each other intersect in a longitudinal axis L. The first longitudinal central plane M1 is spanned by the longitudinal axis L as well as a transverse direction Q. The second longitudinal central plane M2 is spanned by the longitudinal axis L as well as a lateral direction S. The lateral direction S and the transverse direction Q are oriented at a right angle with respect to each other.

Figure 4:
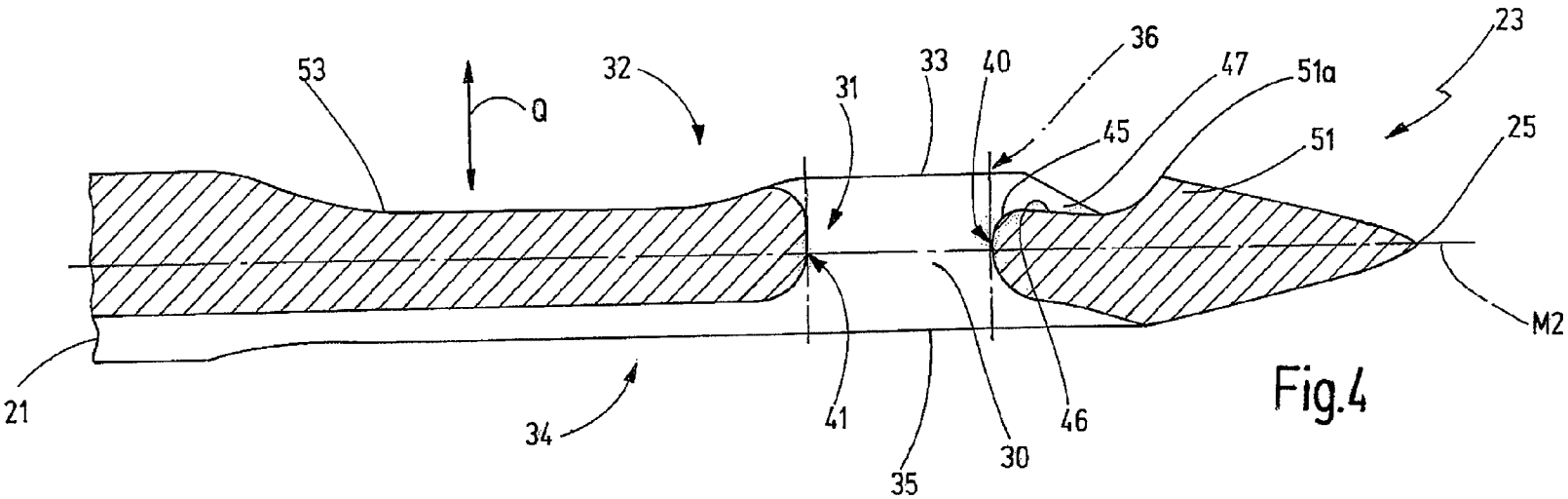
FIG. 4 a sectional view, along the intersection line IV-IV as in FIG. 3, of the working portions according to FIGS. 2 and 3.
Figure 6:
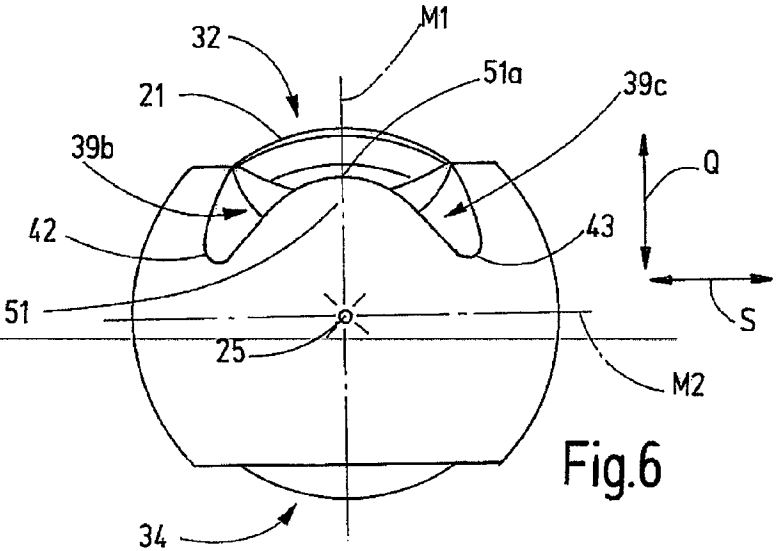
FIG. 6 a view of the needle body according to FIGS. 1 to 5, along the longitudinal axis L of the needle body, onto the needle tip.
Figure 5:
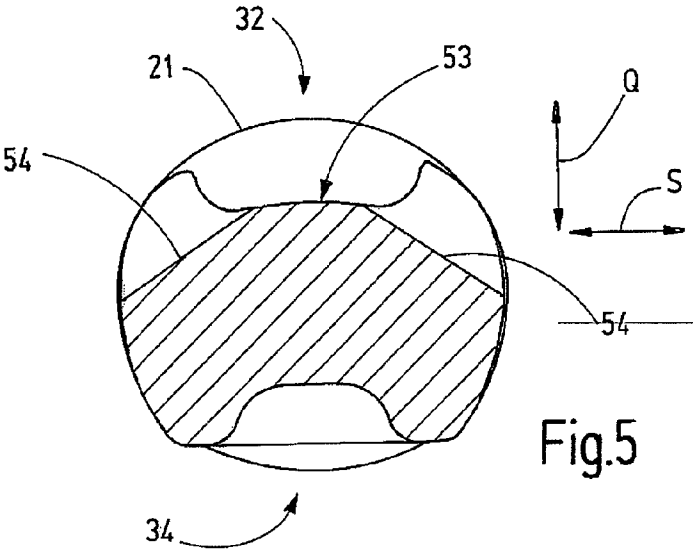
FIG. 5 a sectional view through the working portion as in FIGS. 2 to 4, along intersection line V-V as in FIG. 3.
Figure 7:
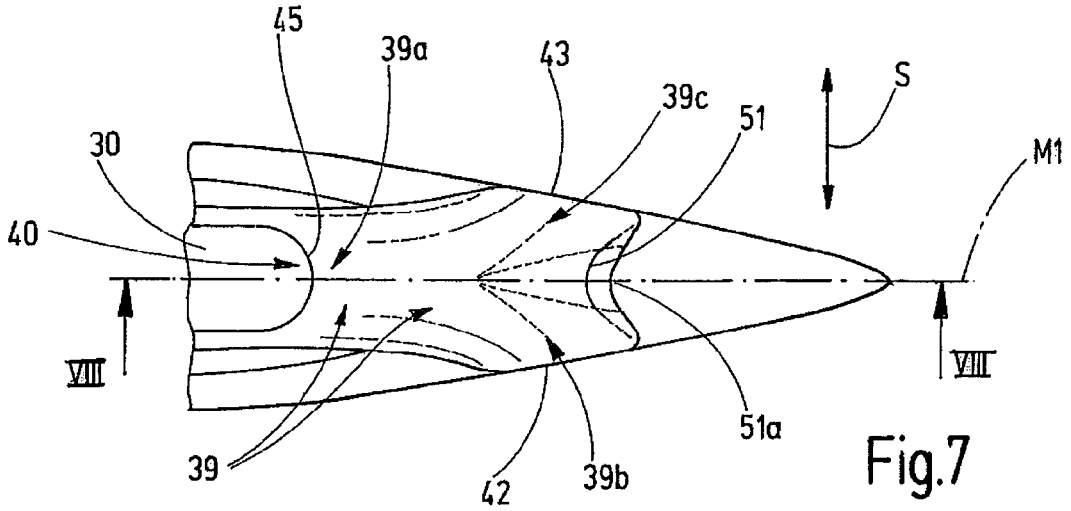
FIG. 7 a partial illustration of the working portion, in the view as in FIG. 3.
Figure 18:
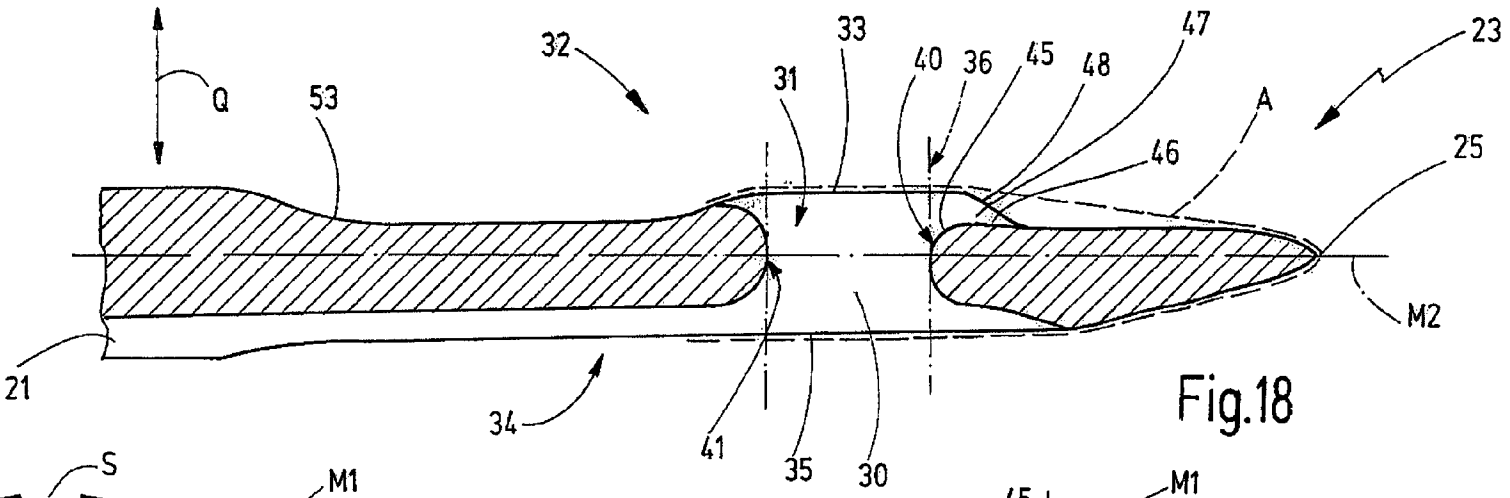
FIG. 18 a sectional view of the working portion according to FIGS. 16 and 17, along line of intersection XVIII-XVIII as in FIG. 17.
Figure 20:
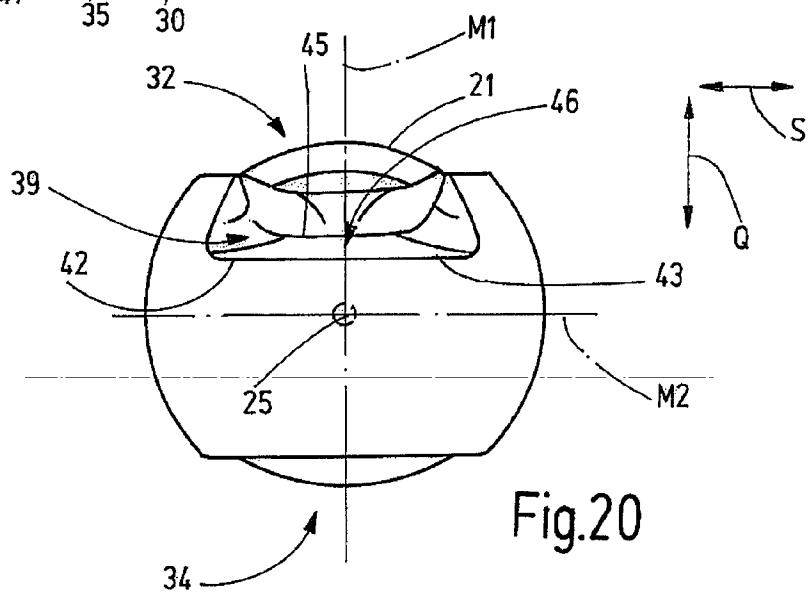
FIG. 20 a view of the needle body according to FIGS. 15 to 19, along the longitudinal axis L of the needle body, onto the needle tip.
Figure 19:
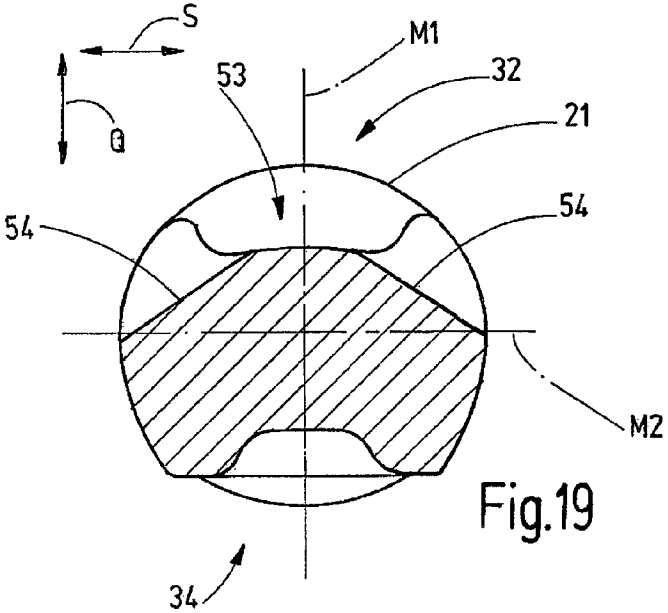
FIG. 19 a sectional view through the working portion according to FIGS. 16 to 19, along intersection line XIX-XIX as in FIG. 17.

In the working portion 23, the needle body 21 has a needle eye 30. The needle eye 30 extends completely through the needle body 21 in transverse direction Q. Consequently, an upper thread can be threaded through the needle eye 30 in the vicinity of the transverse direction Q. In the direction of the longitudinal axis L, the dimension of needle eye 30 is greater than the lateral direction S. There is formed, as it were, a type of elongated hole. In lateral direction S, the needle eye 30 is delimited by two opposing lateral walls 31. In accordance with the example, the lateral walls 31 extend, at least in sections, in a plane parallel to the longitudinal axis L and the transverse direction Q. Each lateral wall 31 has, on its front face 32 of the needle body 21, a first lateral wall edge 33 and has, on a back side 34 of the needle body 21 opposite the front face 32 in transverse direction Q, a second lateral wall edge 35. The two lateral wall edges 33, 35 extend mostly parallel to the longitudinal axis L or convexly curved away from the second longitudinal central plane M2—at least in the region of the needle eye 30 where the needle eye 30 has a patent clearance gauge profile 36 (FIGS. 4 and 18).

Figure 3:
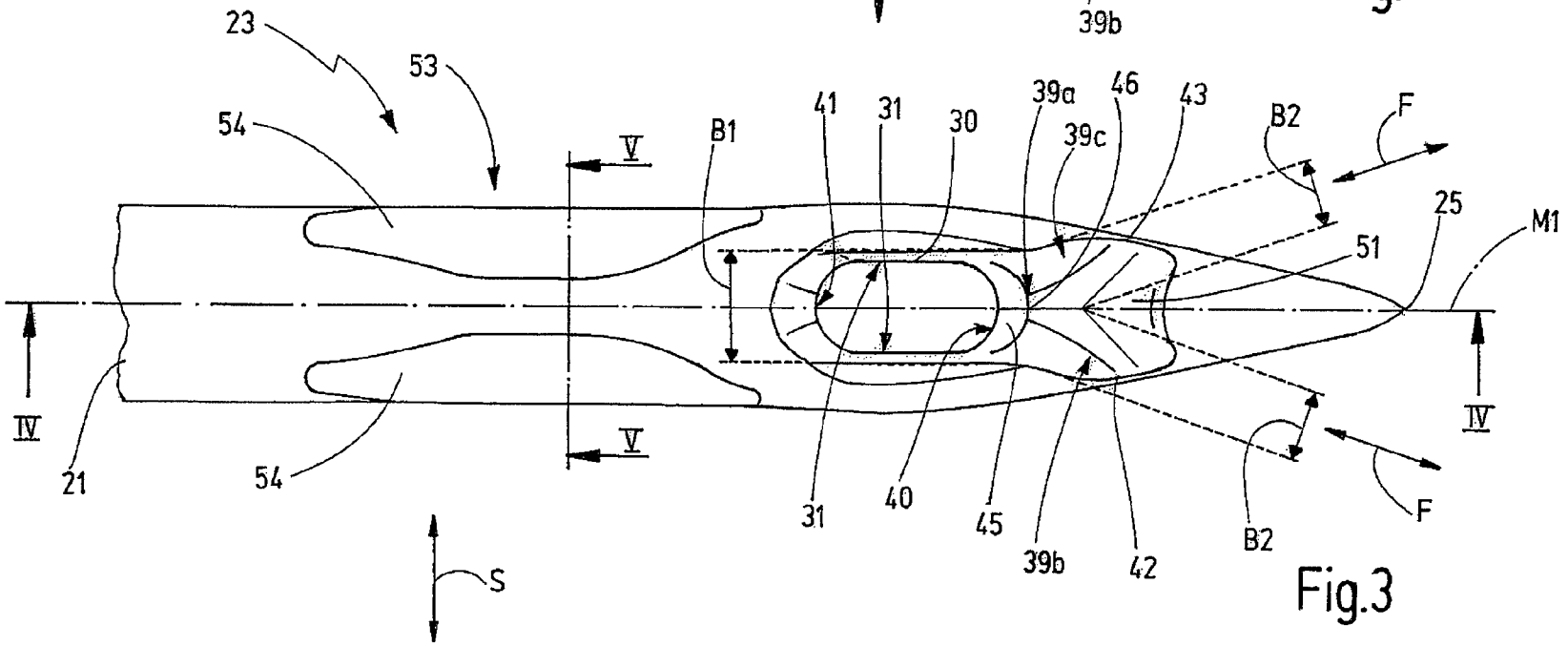
FIG. 3 a view in transverse direction of the working portion according to FIG. 2.
Figure 17:
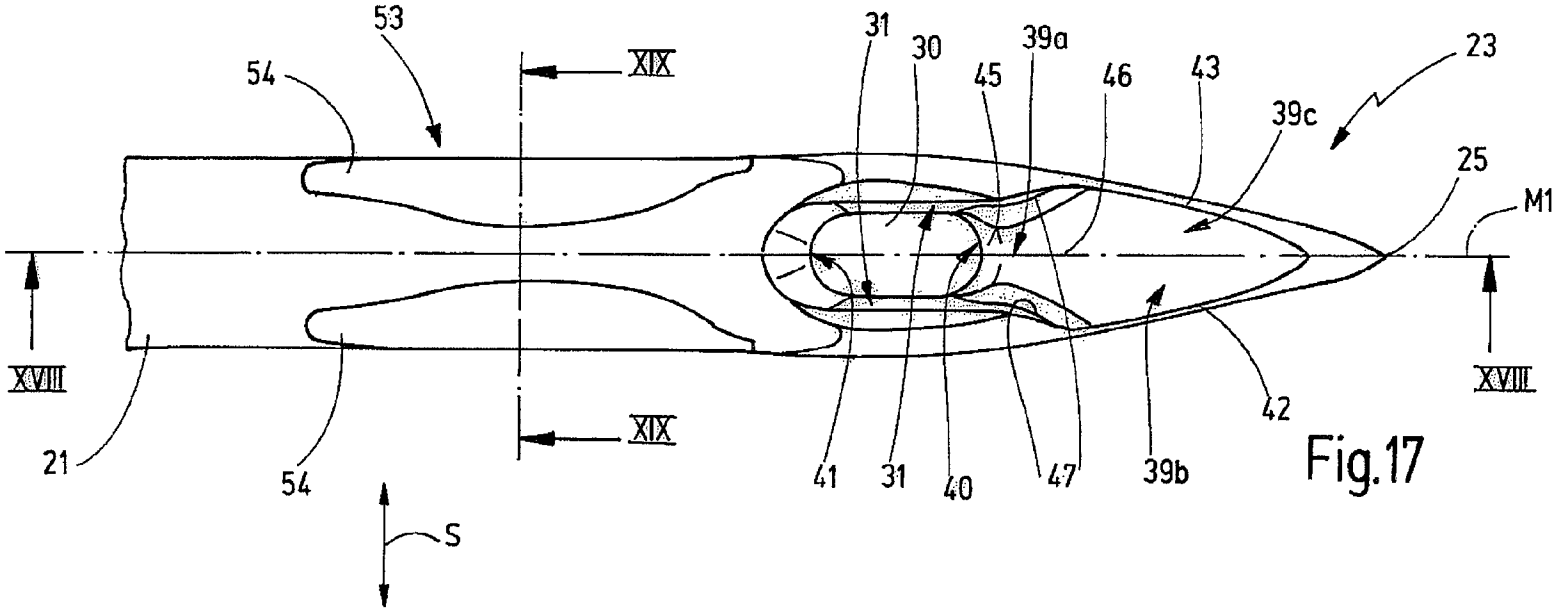
FIG. 17 a view, in transverse direction, of the working portion according to FIG. 16.

The two lateral walls 31 that delimit the needle eye 30 are connected to each other on the side associated with the needle tip 25 by a lower transverse surface 40 and on the opposite side by an upper transverse surface 41. The clearance gauge profile 36 is thus delimited by the two transverse surfaces 40, 41 and the two lateral walls 31. The transverse surfaces 40, 41—looking down onto the needle eye 30, i.e., in transverse direction Z—are arcuate (FIGS. 3 and 17). In addition, the transverse surfaces 40, 41 may extend in an arcuate manner, at least in sections in each projection plane that is parallel to the first longitudinal central plane M1 (FIGS. 4 and 18).

Provided in the tapering region 24 of the working portion 23 there is provided a thread groove 39 in the front face 32 of the needle body 21. In the exemplary embodiments shown here, the thread groove is arranged symmetrically with respect to the first longitudinal central plane M1. The thread groove 39 has a groove portion 39*a* adjacent the needle eye 30. On the side of the needle eye 30 associated with the tip 25, the groove portion 39*a* transitions into the needle eye 30. In other words, the groove portion 39*a* forms a lower edge 45 with the lower transverse surface 40.

Furthermore, the thread groove 39 has two thread groove openings 42, 43. In the embodiments described herein, two end portions 39*b*, 39*c* of the thread groove 39 adjoin the groove portion 39*a*, with respectively one thread groove opening 42 and 43, respectively. Relative to an envelope or outer contour surface A of the working portion 23 of the sewing needle 20, the thread groove 39 is provided in the needle body 21 and terminates on one end of the needle eye 30 and, at a distance therefrom, on the two thread groove openings 42, 43 in the outer contour surface A. The twist groove formed by the thread groove may also be referred to as a double twist groove due to the thread groove openings 42, 43.

Figure 16:
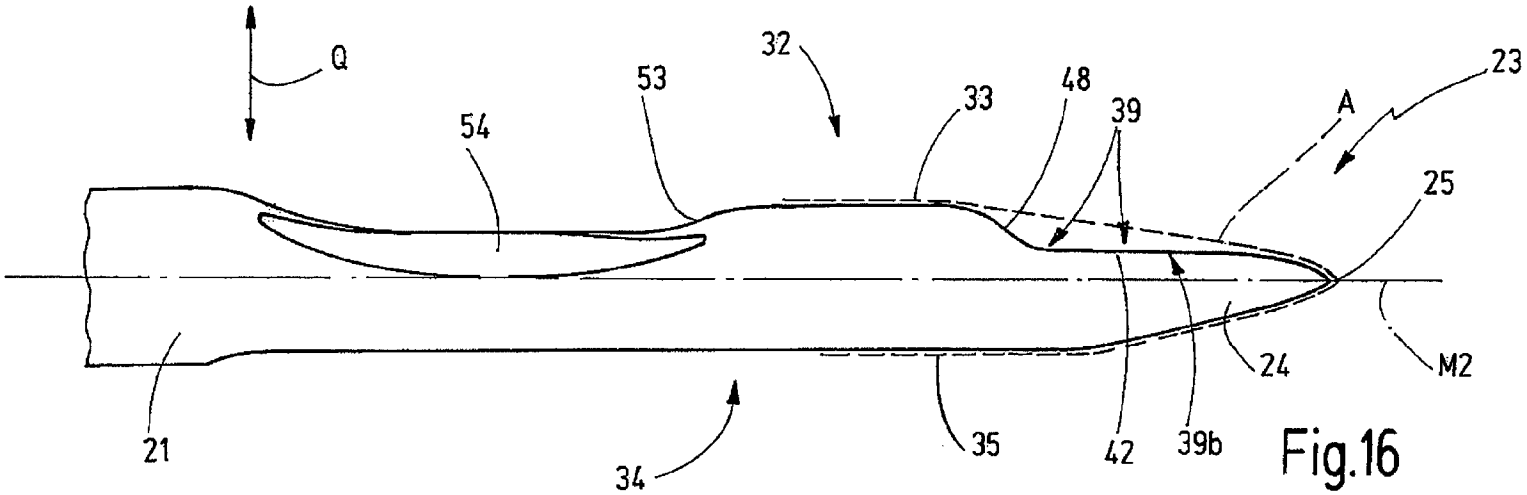
FIG. 16 a side view, in lateral direction, of the working portion of the needle body of the needle according to FIG. 15.

The outer contour surface A of the needle body 21 is specified in the working portion 23 by the enveloping contour. This contour defines a surface that the working portion 23 would have if the needle eye 30 and the thread groove 39 were not present. The outer contour surface A is only depicted schematically in FIGS. 2, 16 and 18.

Here, it is pointed out that the term "edge" in the present version is understood not to mean a sharp, angled edge. Rather, the edges of the lower edge 45 or the lateral wall edges 33, 35, for example, are rounded or have a radius in order not to form sharp edges on the needle body 21 that could damage the thread.

In FIGS. 4 and 18, the working portion 23 of the needle body 21 is sectioned along the first central plane M1. There, the thread groove 39 has a vertex line that extends along the direction of progression of the thread groove 39 or the thread guiding direction and forms a groove bottom 46. In the groove portion 39*a*, the vertex line extends—beginning at the lower edge 45—along the first longitudinal central plane M1. In the region of the groove portion 39*a* opposite the second longitudinal central plane M2, the groove bottom 46 extends in an inclined manner. The distance of the groove bottom 46 from the longitudinal axis L and from the second longitudinal axis M2, respectively, decreases in the region of the groove portion 39*a* in the direction of the longitudinal axis L—beginning at the needle eye 30 or the lower edge 45—toward the needle tip 25.

In the exemplary embodiment of the sewing needle 20 according to FIGS. 15 to 20, the groove bottom 46 is preferably flat along the entire thread groove in lateral direction S. As a modification thereof it could also be curved convexly, which is different from the depiction.

Figure 8:
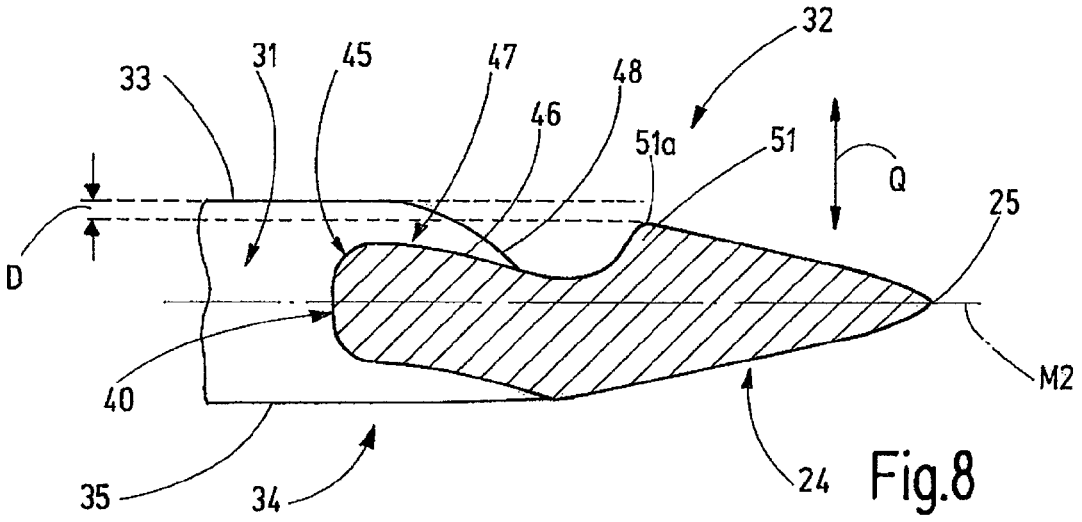
FIG. 8 a sectional view through the part of the working portion shown in FIG. 7, along the intersection line VIII-VIII.

Adjoining the clearance gauge profile 36 each of the two lateral walls 31 has a lateral wall region 47. The two lateral wall regions 47 delimit the groove portion 39*a* adjoining the lower edge 45 in lateral direction S. In accordance with the example, the lateral wall region 47 transitions—without edges and offsets—into the region of the lateral wall 31 arranged adjacent to the clearance gauge profile 47 of the needle eye 30. The upper lateral wall edge 33 continues in the lateral wall region 47 in an edge portion 48 that approaches the second longitudinal central plane M2 with a decreasing distance from the needle tip 25. In accordance with the example, the edge portion 48 extends in an arcuate manner. The distance of said edge portion from the second longitudinal central plane M2 is smaller at each point than the distance of the first lateral wall edge 33 from the second longitudinal central plane M2 in the region of the clearance gauge profile 36 (FIG. 8).

Adjoining the groove portion 39*a*, the thread groove 39 has two end portions 39*b*, 39*c*, each of which having a thread groove opening 42, 43. In accordance with the example, the two end portions 39*b*, 39*c* extend on different sides of the first longitudinal central plane M1 that, in doing so, may act as the dividing surface between the two end portions 39*b*, 39*c*.

In the exemplary embodiment according to FIGS. 1 to 9, the two end portions 39*b*, 39*c* are separated from each other in the region of the first longitudinal central plane M1. The elevation 51 is preferably symmetrical with respect to the first longitudinal central plane M1 and, in accordance with the example, is configured as a convex elevation or as a protuberance. In the transition region of the two end portions 39*b*, 39*c* the elevation 51 is rounded and has neither edges nor offsets. During a sewing operation, a thread may thus slide—without being damaged—from one end portion 39*b*, 39*c* to respectively the other end portion 39*c* and/or 39*b*.

The elevation 51 between the two end portions 39*b*, 39*c* of the first exemplary embodiment (FIGS. 1 to 9) does not project through this outer contour surface A.

Looking down on the elevation 51 in transverse direction Q, the width of said elevation decreases continually in lateral direction S along the longitudinal axis L away from the needle tip 25. Similarly, the height of the elevation 51 decreases in transverse direction Q along the longitudinal axis L away from the needle tip 25. The elevation 51 has a vertex 51*a*, at which the elevation 51 is at its greatest distance from the second longitudinal central plane M2. The vertex 51*a* is located in the first longitudinal central plane M1. The distance of the vertex 51*a* from the second longitudinal central plane M2 in transverse direction Q is smaller by a difference D than the distance of the first lateral wall edges 33 from the second longitudinal central plane M2 in transverse direction Q (FIG. 8). The distance of the first lateral wall edges 33 is measured in the region of the opening of the needle eye 30, i.e., in the region of the clearance gauge profile 36. The distance of the second lateral wall edges 35 from the second longitudinal central plane M2 is preferably also greater than the distance of the vertex 51*a* from the second longitudinal central plane M2 and, for example, may be as great as the distance of the first lateral wall edges 33 from the second longitudinal central plane 212. As a result of this, large-dimension lateral walls 31 can be achieved in transverse direction Q, said lateral walls imparting the sewing needle 20 with good stability in the region of the needle eye 30.

Different from the first exemplary embodiment according to FIGS. 1 to 9, the two end portions 39B, 39*c* in the second exemplary embodiment according to FIGS. 15 to 20 are not separated from each other by an elevation 51. Rather the groove bottom 46 is preferably patent in lateral direction S, so that the two end portions 39*b*, 39*c* transition directly, without offsets and without edges, into each other on the first longitudinal central plane M1. Consequently, the two thread groove openings 42, 43 abut directly against each other in the first longitudinal central plane M1. Consequently, looking along transverse direction A onto the working portion 23, the thread groove 39 has a contour that—beginning at the needle eye 30—initially widens in lateral direction S along the first groove portion 39*a* toward the needle tip 25. The two end portions 39*b*, 39*c* begin at the point, at which the edge portions 48 of the lateral wall regions 47 transition into the groove bottom 46. The two end portions 39*b*, 39*c* together have a common contour that tapers from the groove portion 39*a* toward the needle tip 25. Therefore, the thread groove 39 has a dimension in lateral direction S that—beginning at the groove portion 39*a*—decreases along the two end portions 39*b*, 39*c* in the direction of the needle tip 25. As a result of this, the thread groove 39 has a triangular contour on both end portions 39*b*, 39*c*, viewed in transverse direction Z, wherein the lateral lines of this triangle may extend in an arcuate manner. In this exemplary embodiment, the thread groove 39 has the largest dimension at the transition point between the groove portion 39*a* toward the two end portions 39*b*, 39*c* and in lateral direction S.

The elevation 51 forms the substantial difference between the two exemplary embodiments illustrated and described here. In the second exemplary embodiment according to FIGS. 15 to 20, the elevation 51 between the two end portions 51 is removed and replaced by a patent inside surface of the thread groove. Other than that the two exemplary embodiments of the sewing needle 20 are identical.

The thread groove 39 is open toward the front face 32. On the two thread groove openings 42, 43 the thread groove 39 additionally opens in lateral direction S on both sides of the first longitudinal central plane M1. In the exemplary embodiments, the thread groove 39 is, or at least the two end portions 39*b*, 39*c* are—viewed relative to the second longitudinal central plane M2—provided only on one side. The thread groove 39 thus does not extend through the second longitudinal central plane M2, but it can reach the second longitudinal central plane M2.

Figure 9:
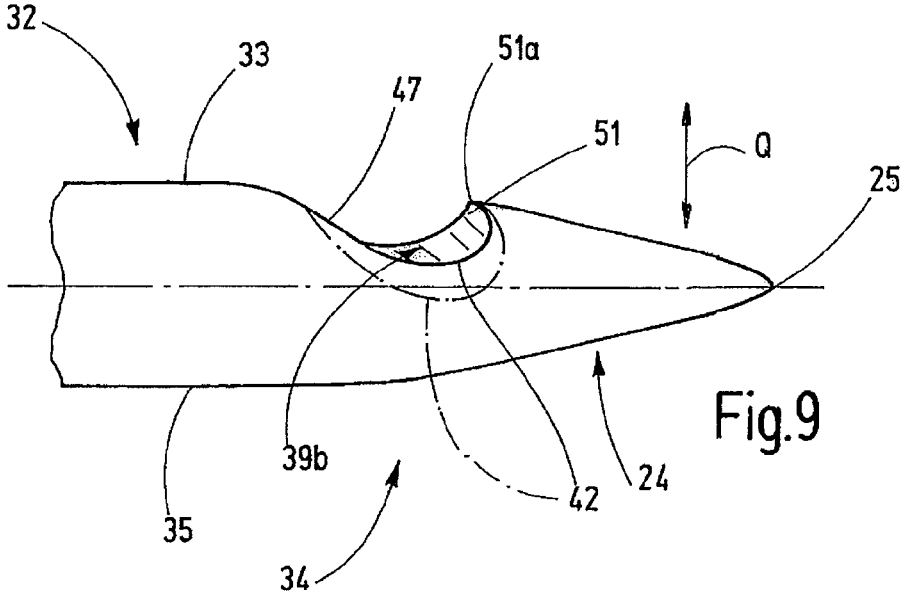
FIG. 9 a side view in lateral direction, of the part of the working portion according to FIGS. 7 and 8.

In modification thereto, it is also possible that at least the two end portions 39*b*, 39*c* extend though the second longitudinal central plane M2, which is illustrated in a highly schematized manner by chain lines in FIG. 9. In expansion of the last-mentioned embodiment, it is even possible that the entire thread groove 39—viewed from the front face 32—be located on the other side of the second longitudinal central plane M2. Additionally or alternatively, the groove portion 39*a* may also extend through the longitudinal central plane M2.

However, in the preferred embodiment, the second longitudinal central plane M2 is at no point intersected by the thread groove 39, and is touched at most. This has the advantage that the sewing needle 20 can be manufactured in a very simple manner by forming, in particular by stamping.

The thread groove 39 represents a twist groove of a sewing needle 20 that, in the illustrated exemplary embodiment, is configured so as to be symmetrical to the first longitudinal central plane M1. Preferably, the sewing needle 20 as a whole is configured so as to be symmetrical to the first longitudinal central plane M1.

FIG. 3 shows, schematically, the width of the twist groove or the thread groove 39 at various points of the first exemplary embodiment according to FIGS. 1 to 9. The groove portion 39*a* has a width B1 in lateral direction S that is at least as great as the minimum distance of the two lateral walls 31 in lateral direction S. Each of the two end portions 39*b*, 39*c* has a width B2 that is smaller than the width B1 of the groove portion 39*a*. The width B2 of the respective end portion 39*b*, 39*c* is measured at a right angle relative to a thread guiding direction F. The thread guiding direction F results from the direction of the respective edge portion 48 that borders the respective end portion 39*b*, 39*c*.

On the side of the needle eye 30 opposite the thread groove 39, there is provided a gripper opening 53 in the working portion 23 on the front face 32 of the needle body 21. In the region of the gripper opening 53 the needle body 21 has thus, in transverse direction Q, a lower thickness than in the two regions adjoining on the gripper opening 53 along the longitudinal axis L. Due to this gripper opening 53, a gripper of a sewing machine can better grasp an upper thread moving on the front face 32 along the needle body 21 and loop it around the lower thread. The gripper opening 53 has two bevels 54 that are arranged symmetrically relative to the first longitudinal central plane M1 (FIGS. 3 and 5 or 17 and 19). However, it is also possible to provide the bevel only on one side or to configure the opening so as to be asymmetrical in another manner relative to the longitudinal central plane M1. The sewing needle 20 may interact, with the grippers of a sewing machine that, viewed in lateral direction S, grasps the thread from one side or the other. As a result of this, the sewing needle 20 is also suitable for use in a sewing machine with two sewing needles. Due to the symmetrical configuration of the sewing needle 20 relative to the first longitudinal central plane M1, there is no confusion even when two needles are used in the sewing machines. In such a sewing machine, two of the described sewing needles 20 can be used without the risk of confusion.

Figure 10:
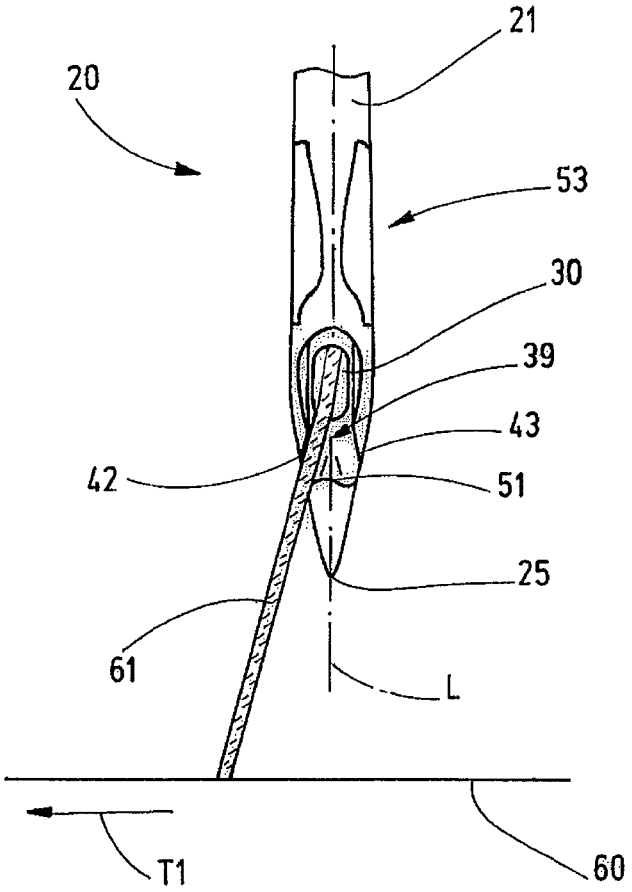
FIGS. 10 to 14, respectively, one schematic representation of a position of the sewing needle and the thread during the sewing operation.
Figure 11:
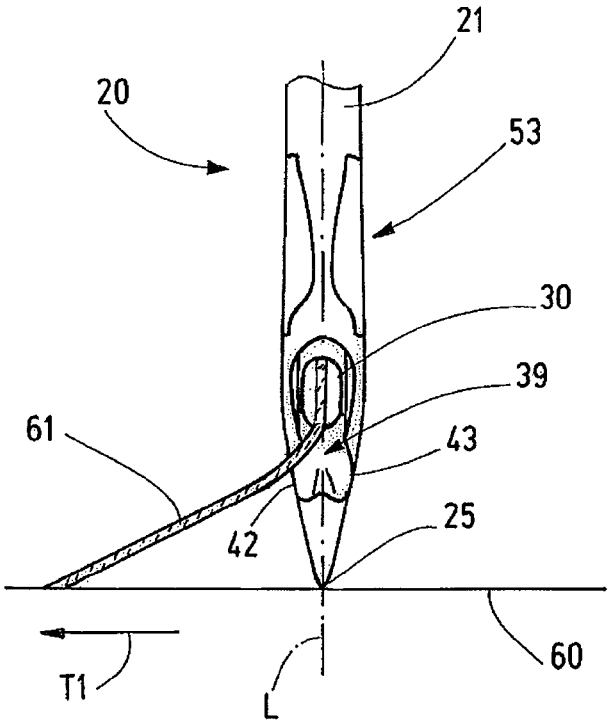
Figure 12:
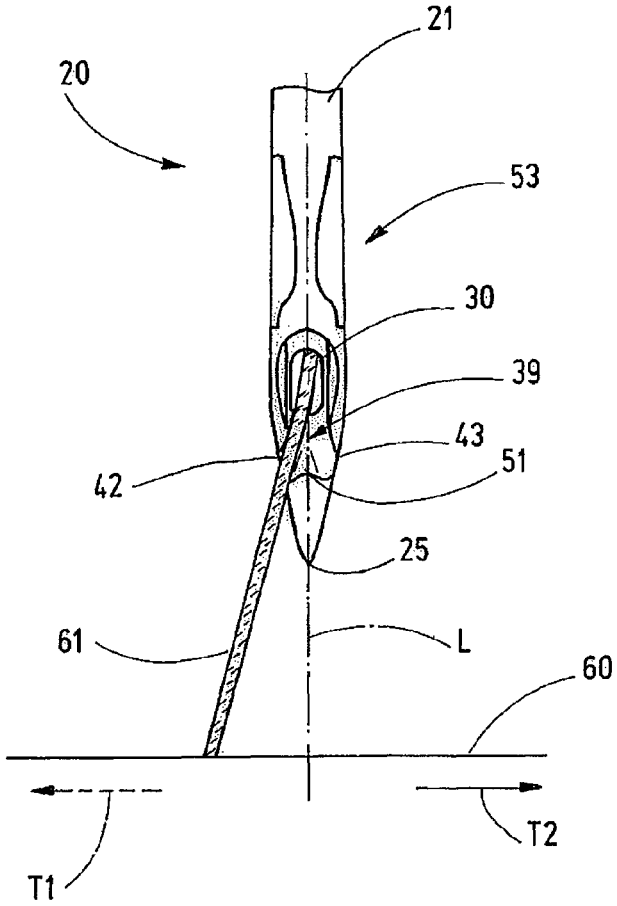

With reference to FIGS. 10 to 14, the use of the sewing needle 20 in a sewing machine while the material 60 is being sewn is explained. This explanation applies to all exemplary embodiments, even though the FIGS. 10 to 4 show the first exemplary embodiment of the sewing needle 20 according to FIGS. 1 to 9 as an example.

In FIG. 10 the needle 20 is at a distance from the sewn material 60. The upper thread 61 extends from the last stitch in the sewn material 60 through the needle eye 30 of the needle 20. The sewn material 60 is moved in a first transport direction T1. The first transport direction T1 is oriented parallel to lateral direction S of the needle 20. In doing so, the needle 20 moves along its longitudinal axis L downward toward the sewn material 60. At least until the needle tip 25 punctures the sewn material 60, the upper thread 61 remains within one of the two thread groove openings 42, 43 and, in accordance with the example, in the first thread groove opening 42. As a result of this, an unexpected twist shifting of the upper thread 61 is prevented.

Figure 13:
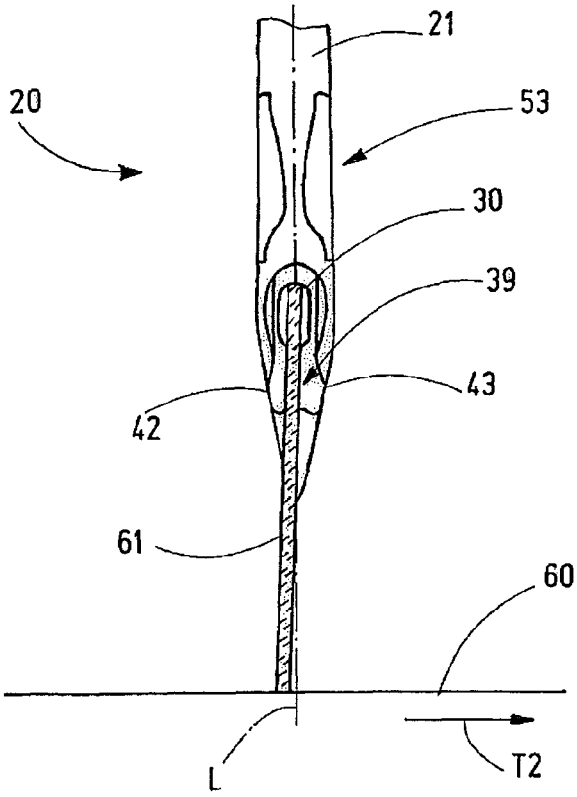
Figure 14:
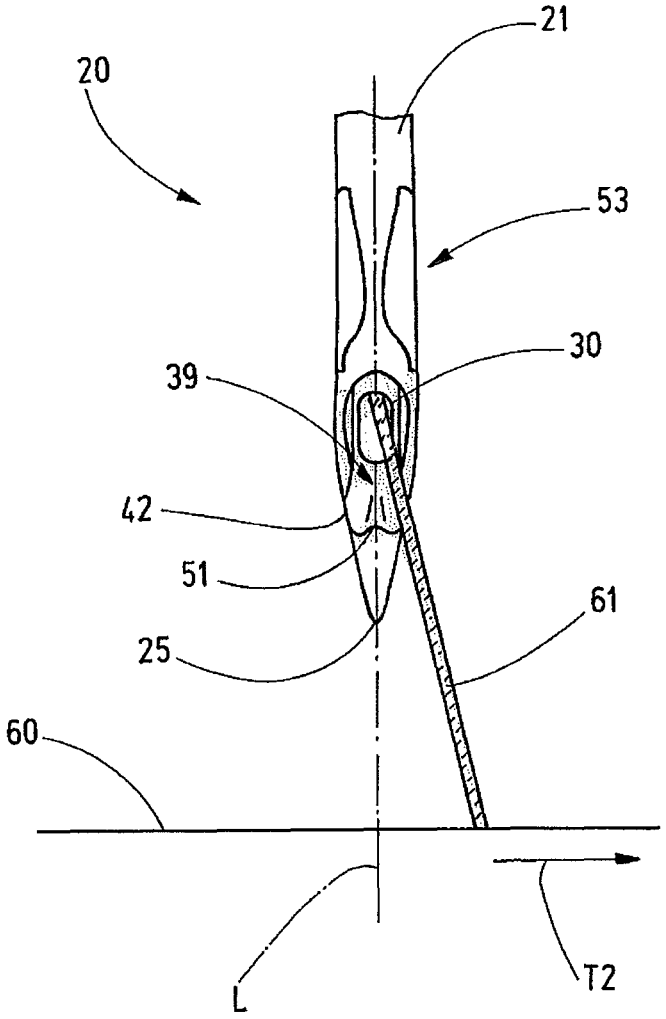

In FIG. 12, the needle 20 is again in its initial position as shown in FIG. 1—after its return stroke from the sewn material 60. Now, it is assumed that the transport direction of the sewn material 60 is reversed. For the continued sewing process, the sewn material is moved into a second transport direction 12 that is counter the first transport direction T1. During this reversal of direction, the thread portion of the upper thread 61 extending from the needle eye 30 to the sewn material 60 is moved from the first thread groove opening 42—optionally via the existing elevation 51—into the second thread groove opening 43 (FIGS. 13 and 14). In doing so, the upper thread 61 slides over the convex elevation 51 having no edges and offsets between the two end portions 39*b*, 39*c*, provided it exists. In doing so, a twist shifting of the upper thread 61 is at least substantially avoided. The upper thread 61 is not moved over an angled sharp edge or offset that almost coincides with the extension direction of the upper thread 61, which can lead to a twisting or untwisting of the upper thread 61.

After performing the reversal of the transport direction, the sewn material 60 is subsequently moved into the second transport direction T2, and the sewing needle 20 performs a stroke movement along its longitudinal axis L. Analogously to the situation illustrated by FIGS. 10 and 11, the upper thread 61, in doing so, remains in the second thread groove opening 43 as long as the sewing needle 20 has not yet punctured the sewn material 60.

Consequently, in accordance with the example, the sewing needle 20 is provided for sewing in at least two opposing transport directions T1, T2.

Sewing needles according to the invention are preferably equipped with a displacement tip or a cutting tip.

The invention relates to a sewing needle 20 for use in a sewing machine. The sewing needle 20 has a working portion 23 with a needle eye 30 and a region 24 which tapers into a needle tip 25. The needle eye 30 passes through a needle body 21 of the sewing needle 20 in a transverse direction Q perpendicularly to a longitudinal axis L of the needle body 21. A twist groove is introduced into a front face 23 of the needle body 21 in a recessed manner relative to the outer contour of the needle body 21, said twist groove extending in the direction of the needle tip 25 from the needle eye 30. The twist groove is formed by a thread groove 39 with two thread groove openings 42, 43. The twist groove is preferably symmetrical relative to a first longitudinal central plane M1 which is spanned by the longitudinal axis L and the transverse direction Q. The thread groove 39 has a groove portion 39*a* adjacent to the needle eye 30. The threaded groove has two end portions 39*b*, 39*c*, each of which comprising a thread groove opening 42, 43, at a distance to the needle eye 30. In one exemplary embodiment, a convex rounded elevation 51 can separate the two end portions 39*b*, 39*c* from each other. The elevation 51 is preferably configured so as to be symmetrical with respect to the first longitudinal central plane M1.

LIST OF REFERENCE SIGNS

20 Sewing needle
21 Needle body
22 Needle holding portion
23 Working portion
24 Tapering region
25 Needle tip
26 Shank portion
30 Needle eye
31 Lateral wall
32 Front face
33 First lateral wall edge
34 Back side
35 Second lateral wall edge
36 Clearance gauge profile
39 Thread groove
39*a* Thread groove portion
39*b* First end portion
39*c* Second end portion
40 Lower transverse surface
41 Upper transverse surface
42 First thread groove opening
43 Second thread groove opening
45 Lower edge
46 Groove bottom
47 Lateral wall region
48 Edge portion
51 Elevation
51*a* Vertex
53 Gripper opening
54 Bevel
60 Sewn material
61 Upper thread
A Outer contour surface
B1 Width of the groove portion
B2 Width of an end portion
F Thread guiding direction
L Longitudinal axis
M1 First longitudinal central plane
M2 Second longitudinal central plane
Q Transverse direction
S Lateral direction
T1 First transport direction
T2 Second transport direction

The invention claimed is:

1. A sewing needle for a sewing machine, comprising:

a needle body extending along a longitudinal axis, said needle body comprising a holding portion for clamping the sewing needle in the sewing machine and a working portion including a needle tip of the sewing needle, a needle eye provided in the working portion of the needle body, said needle eye completely extending through the needle body, a thread groove provided between the needle eye and the needle tip and which terminates, on a lower edge of the needle eye facing the needle tip, in the needle eye, and wherein the thread groove has, at a distance from the needle eye, a first thread groove opening and a second thread groove opening, said first groove opening and said second groove opening being arranged on different sides of a first longitudinal central plane through the needle body.

2. The sewing needle according to claim 1, wherein a distance between the first thread groove opening and the second thread groove opening in a lateral direction at a right angle with respect to the first longitudinal central plane is greater in at least a few points than a width of the thread groove in the lateral direction at a point adjacent the needle eye.

3. The sewing needle according to claim 1, wherein one dimension of the thread groove in a lateral direction at a right angle with respect to the first longitudinal central plane increases starting from the needle eye in the direction of the two thread groove openings.

4. The sewing needle according to claim 1, wherein the thread groove has a groove portion that directly adjoins the needle eye.

5. The sewing needle according to claim 4, wherein the groove portion is delimited on opposite sides by one lateral wall region of a lateral wall delimiting the needle eye.

6. The sewing needle according to claim 4, wherein a groove bottom of the groove portion approaches the longitudinal axis starting from the needle eye in the direction of the needle tip.

7. The sewing needle according to claim 4, wherein the thread groove has two end portions that extend between respectively one thread groove opening and the groove portion.

8. The sewing needle according to claim 7, wherein the end portions of the thread groove are provided in the region of a working portion, said region tapering toward the needle tip.

9. The sewing needle according to claim 7, wherein a width of the end portions is smaller than a width of the groove portion.

10. The sewing needle according to claim 7, wherein an elevation is provided between the two end portions of the thread groove.

11. The sewing needle according to claim 10, wherein the elevation transitions, without edges, into the two end portions of the thread groove.

12. The sewing needle according to claim 10, wherein the elevation is convexly curved and has a vertex on the first longitudinal central plane.

13. The sewing needle according to claim 1, wherein the thread groove does not extend through a second longitudinal central plane through the needle body, said plane being oriented at a right angle with respect to the first longitudinal central plane.

14. The sewing needle according to claim 1, wherein the needle eye is delimited on opposite sides of the first longitudinal central plane by one lateral wall that borders the outer contour surface of the needle body on one lateral wall edge.

15. The sewing needle according to claim 14, wherein the lateral wall edge is at a maximum distance from a second longitudinal central plane oriented at a right angle with respect to the first central longitudinal plane, said distance being greater than a maximum distance of the elevation with respect to the second longitudinal central plane.

* * * * *